United States Patent [19]

Komazaki et al.

[11] Patent Number: 5,015,974

[45] Date of Patent: May 14, 1991

[54] ISOLATING CIRCUIT AND DIELECTRIC FILTER FOR USE THEREIN

[75] Inventors: Tomokazu Komazaki; Katsuhitko Gunji; Norio Onishi; Akira Mashimo, all of Tokyo, Japan

[73] Assignee: Oki Electric Industry Co., Ltd., Tokyo, Japan

[21] Appl. No.: 366,516

[22] Filed: Jun. 15, 1989

[30] Foreign Application Priority Data

Jun. 20, 1988 [JP] Japan ..... 63-150136
Sep. 2, 1988 [JP] Japan ..... 63-218475

[51] Int. Cl.[5] ..... H01P 1/213; H01P 1/202

[52] U.S. Cl. ..... 333/134; 333/202; 333/206

[58] Field of Search ..... 333/126, 129, 132, 134, 333/136, 202, 206, 207, 223, 222; 455/78, 80, 82, 83

[56] References Cited

U.S. PATENT DOCUMENTS

| | | | |
|---|---|---|---|
| 4,342,972 | 8/1982 | Nishikawa et al. | 333/136 X |
| 4,382,238 | 5/1983 | Makimoto et al. | 333/134 |
| 4,673,902 | 6/1987 | Takeda et al. | 333/202 |
| 4,692,726 | 9/1987 | Green et al. | 333/206 |
| 4,740,765 | 4/1988 | Ishikawa et al. | 333/202 X |
| 4,742,562 | 5/1988 | Kommrusch | 333/206 X |
| 4,768,003 | 8/1988 | Kawakami et al. | 333/202 |
| 4,799,033 | 1/1989 | Igarashi et al. | 333/134 |

FOREIGN PATENT DOCUMENTS

| | | | |
|---|---|---|---|
| 0214625 | 9/1986 | Japan | 455/83 |
| 0018801 | 1/1987 | Japan | 333/206 |
| 0077703 | 4/1987 | Japan . | |
| 0157402 | 7/1987 | Japan . | |
| 0239701 | 10/1987 | Japan | 333/206 |
| 0000961 | 1/1988 | Japan . | |
| 0124601 | 5/1988 | Japan | 333/206 |
| 0174402 | 7/1988 | Japan | 333/206 |

OTHER PUBLICATIONS

Atsushi Fukasawa, "Analysis and Composition of a New Microwave Filter Configuration with Inhomogeneous Dielectric Medium," IEEE Transactions on Microwave Theory and Techniques, vol. MTT-30, No. 9, Sep. 1982, pp. 1367-1375.

"Dielectric Filter with Attenuation Pole for Mobile Radio"; Electron Information Communication Society, CAS 88-10, dated Jun. 23rd, 1988.

*Primary Examiner*—Eugene R. LaRoche
*Assistant Examiner*—Seung Ham

[57] ABSTRACT

An isolating circuit, which isolates a first frequency signal in a first frequency range and a second frequency signal in a second frequency range which is higher than the first frequency range, has as antenna terminal, a first filter and a second filter. The first filter, having a first input terminal and a first output terminal, receives a first input signal including the first frequency signal at the first input terminal and attenuates first frequency component of the first input signal below the first frequency range at a first attenuation rate and second frequency components of the first input signal above the first frequency range at a second attenuation rate. One of the first input and output terminals of the first filter is coupled to the antenna terminal. The first filter further has a first setting terminal setting the first attenuation rate and the second attenuation rate so that the second attenuation rate is greater than the first attenuation rate. The second filter, having second input and output terminals, receives a second input signal including the second frequency signal at the second input terminal and attenuataes third frequency components of the second input signal below the second frequency range at a third attenuation rate and fourth frequency components of the second input signal above the second frequency range at a fourth attenuation rate. One of the second input and output terminals of the second filter is coupled to the antenna terminal. The second filter further has a second setting terminal setting the third attenuation rate and fourth attenuation rate so that the third attenuation rate is greater than the fourth attenuation rate.

13 Claims, 6 Drawing Sheets

ISOLATING CIRCUIT AND DIELECTRIC FILTER FOR USE THEREIN

CROSS REFERENCE TO RELATED APPLICATION

The present disclosure relates to the subject matter disclosed in Japanese patent application Ser. Nos. 63-150136 filed on June 20, 1988 and 63-218475 filed on Sept. 2, 1988, the entire disclosure of which are incorporated by reference.

BACKGROUND OF THE INVENTION

The present invention relates to an isolating circuit and a pair of dielectric filters for use therein. More particularly, the invention relates to an isolating circuit, such as a duplexer or an isolator, for isolating a first frequency signal in a first frequency range and a second frequency signal in a second frequency range which is higher than the first frequency range, and still more particularly a duplexer well adapted for a mobile telephone.

The demand for mobile telephone services in large cities such as New York, London, Tokyo etc. has suddenly expanded more than initially expected. This has caused a shortage in the number of channels for communication services. In order to solve this shortage, there are mobile telephone service corporations which are planning or which have already carried out an increase in the number of channels, for example, from 666 channels to 832 channels in the U.S. and from 600 channels to 1320 channels in the U.K., as described in a publication by Tomokazu Komazaki et al. entitled "Dielectric Filter with Attenuation Pole for Mobile Radio", Electron Information Communication Society, CAS88-10, dated June 23, 1988, the entire disclosure of which is incorporated by reference.

In accordance with the channel number increase, it is necessary to extend the bandwidth for radio communications. In the U.S., the transmitting frequency band and receiving frequency band have respectively extended from 825–845 MHz to 824–849 MHz and from 870–890 MHz to 869 894 MHz. As a consequence, a duplexer is required so as to more effectively isolate the transmitter and the receiver to permit simultaneous operation since the transmitting and receiving frequencies are more closely spaced. Dielectric filters which may be used in such a duplexer are disclosed in Japanese laid-open patent publication Nos. 62-77703 (published on Apr. 9, 1987) and 62-157402 (published on July 13, 1987).

A dielectric filter, disclosed in Japanese laid-open patent publication No. 62-77703 has six dielectric resonators and a reactance circuit formed by a capacitor or an inductor. The reactance circuit, jumping over at least one resonator, connects two resonators out of the remaining resonators of the dielectric filter. As a result the dielectric filters each have an attenuation pole.

Dielectric filter disclosed in Japanese laid-open patent publication No. 62-157402 has four dielectric resonators therein and a coaxial cable having two edge portions. The coaxial cable, jumping over two resonators, couples the two remaining resonators of the dielectric filter through two reactance components, respectively connected to two edge portions thereof. As a result the dielectric filters have two attenuation poles which are asymmetric relative to the center frequency.

SUMMARY OF THE INVENTION

It is an object of the present invention to provide an improved isolating circuit composed of at least two different types of filters, more specifically, the combination of the two different types of filters in order to more effectively isolate a first frequency signal in a first frequency range and a second frequency signal in a second frequency range which is higher than the first frequency range.

It is another object of the present invention to provide an improve dielectric filter for use in the above mentioned isolating circuit.

An isolating circuit according to the invention, in order to isolate a first frequency signal in a first frequency range and a second frequency signal in a second frequency range which is higher than the first frequency range, has an antenna terminal, a first filter and a second filter. The first filter, having a first input terminal and a first output terminal receives to a first input signal including the first frequency signal at the first input terminal and attenuates first frequency components of the first input signal below the first frequency range at a first attenuation rate and second frequency components of the first input signal above the first frequency range at a second attenuation rate. One of the first input and output terminals of the first filter is coupled to the antenna terminal. The first filter further has a first setting terminal setting the first attenuation rate and the second attenuation rate so that the second attenuation rate is greater than the first attenuation rate. The second filter, having second input and output terminals, receives a second input signal including the second frequency signal at the second input terminal and attenuates third frequency components of the second input signal below the second frequency range at a third attenuation rate and fourth frequency components of the second input signal above the second frequency range at a fourth attenuation rate. One of the second input and output terminals of the second filter is coupled to the antenna terminal. The second filter further has a second setting terminal setting the third attenuation rate and the fourth attenuation rate so that the third attenuation rate is greater than the fourth attenuation rate. In accordance with this invention, it is relatively easy to design an isolation circuit which meets the strict requirement of isolating first and second frequency signals that are more closely spaced as discussed previously in the BACKGROUND OF THE INVENTION portion, since all that is needed is to partly change the attenuation frequency characteristics of the first and second filters.

In accordance with another aspect of the invention, a dielectric filter includes a dielectric block having top, bottom, and side surfaces, and further a plurality of interior surfaces defining respective holes each extending from the top to the bottom surfaces thereof. The filter has a side conductive layer covering the side surface, a bottom conductive layer covering said bottom surface and electrically connected to the side layer, and first, second, third and fourth inner conductive layers respectively covering the interior surfaces and electrically connected to the bottom layer. The second inner layer is provided between the first and third inner layers and next to the first inner layer. The third inner layer is provided between the second and fourth inner layers and next to the fourth inner layer. The filter further has a first coupling terminal which inductively and capacitively couples the first inner layer to the second inner layer.

BRIEF DESCRIPTION OF THE DRAWINGS

These and other features and advantages of the invention will be more completely understood from the following detailed description of the preferred embodiments with reference to the accompany drawings in which.

DETAILED DESCRIPTION OF THE PREFERRED EMBODIMENT

Figure 1A:
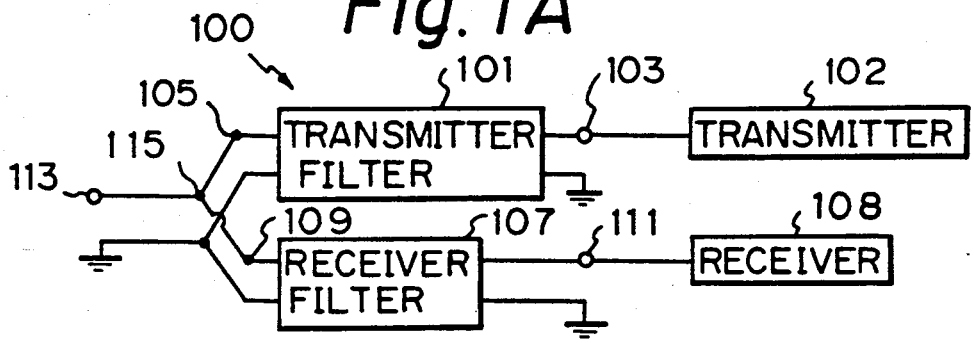
FIGS. 1A and 1B are respectively schematic diagrams of a duplexer 100 and an isolator 150.
Figure 1B:
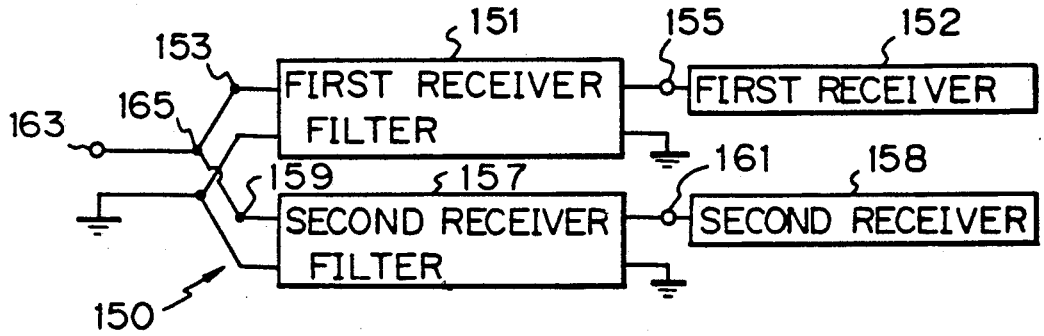

FIGS. 1A and 1B respectively illustrate schematic diagrams of a duplexer 100 and an isolator 150 as two types of isolating circuits.

The duplexer 100 comprises a transmitter filter 101 having an input terminal 103 and an output terminal 105, and a receiver filter 107 having an input terminal 109 and an output terminal 111. The output terminal 105 of the transmitter filter and the input terminal 109 of the receiver filter 107 are commonly coupled to an antenna terminal 113 through a connecting point 115. The transmitter filter 101 and receiver filter 107 are respectively supplied with the ground potential. The input terminal 103 of the transmitter filter 101, connected to a transmitter 102, and the output terminal 111 of the receiver filter 107, connected to a receiver 108, may be grounded through terminal resistors (not shown).

In duplex operation of the transmitter 102 and the receiver 108 connected to a common antenna (not shown), the duplexer 100 is required so as to effectively isolate the transmitter 102 and the receiver 108 to permit simultaneous operation, especially where the transmitting and receiving frequency signals are closely spaced. The transmitter filter 101 of the duplexer 100 passes transmitting frequency signals in a first frequency rang from 824 HMz, to 849 HMz and attenuates signals which are either below 824 MHz or above 849 MHz, The receiver filter 107 passes receiving frequency signals in a second frequency range, from 869 MHz to 894 HMz, and attenuates signals either below 869 HMz or above 894 HMz. Therefore, the duplexer 100 transmits the transmitting frequency signals from the transmitter 102 only into the antenna terminal 113 through the transmitter filter 101, and also transmits the receiving frequency signals from the antenna terminal 113 only into the receiver 108 through the receiver filter 107.

The isolator 150 in FIG. 1B comprises a first receiver filter 151 having an input terminal 153 and an output terminal 155, and a second receiver filter 157 having an input terminal 159 and an output terminal 161. The input terminal 153 of the first receiver filter 151 and the input terminal 159 of the second receiver filter 157 are commonly coupled to an antenna terminal 163 through a connecting point 165. The first and second receiver filters 151 and 157 are supplied with the ground potential. The output terminals 155 and 161 of the first and second receiver filters 151 and 157 are respectively connected to first and second receivers 152 and 158, and may be grounded through terminal resistors (not shown). The first receiver filter 151 passes first receiving frequency signals in a first frequency range and attenuates signals in other frequency ranges while the second receiver filter 157 passes second receiving frequency signals in a second frequency range, higher than the first frequency range, and attenuates signals having other frequencies. Therefore, the isolator 150 transmits the first receiving frequency signals from the antenna terminal 163 only into the first receiver 152 through the first receiver filter 151, and also transmits the second receiving frequency signals from the antenna terminal 163 only into the second receiver 158 through the second receiver filter 157.

As to the preferable connection among the antenna terminal and filters in FIGS. 1A and 1B, this is disclosed in more detail in co-owned U.S. application Ser. No. 7/237,673 filed on Aug. 26, 1988, which is herein incorporated by reference.

Figure 2:
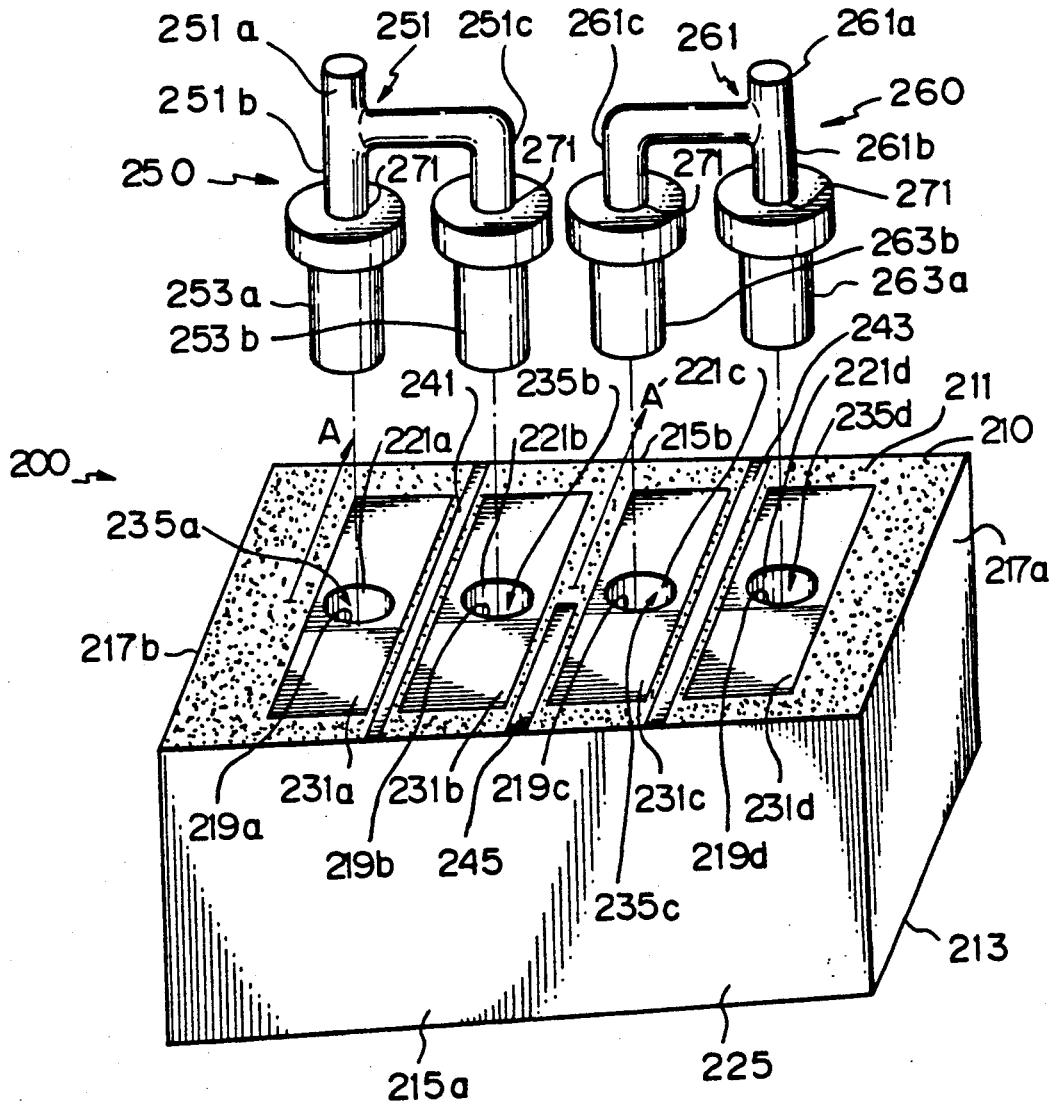
FIG. 2 is a perspective view of a first dielectric filter 200.

FIG. 2, illustrates a first dielectric filter 200 which is applicable to either the transmitter filter 101 in FIG. 1A or the first receiver filter 151 in FIG. 1B.

The first dielectric filter 200 includes a substantially rectangularly shaped block 210 of ceramic materials, primarily BaO and $TiO_2$. The block has a top surface 211, a bottom surface 213, a pair of mutually parallel first side surfaces 215*a* and 215*b* and a pair of mutually parallel second side surfaces 217*a* and 217*b*. The block 210 further has four cylindrical interior surfaces therein which define corresponding holes 219*a*, 219*b*, 219*c* and 219*d* each extending from the top surface 211 to the bottom surface 213 and arranged in a vertical parallel to the first side surface 215*a* and 215*b*. Each of the interior surfaces in the block 210 is entirely covered with a layer of a conductive material such as a silver or copper so as to form inner conductive layers 221*a*, 221*b*, 221*c* and 221*d*.

Figure 3:
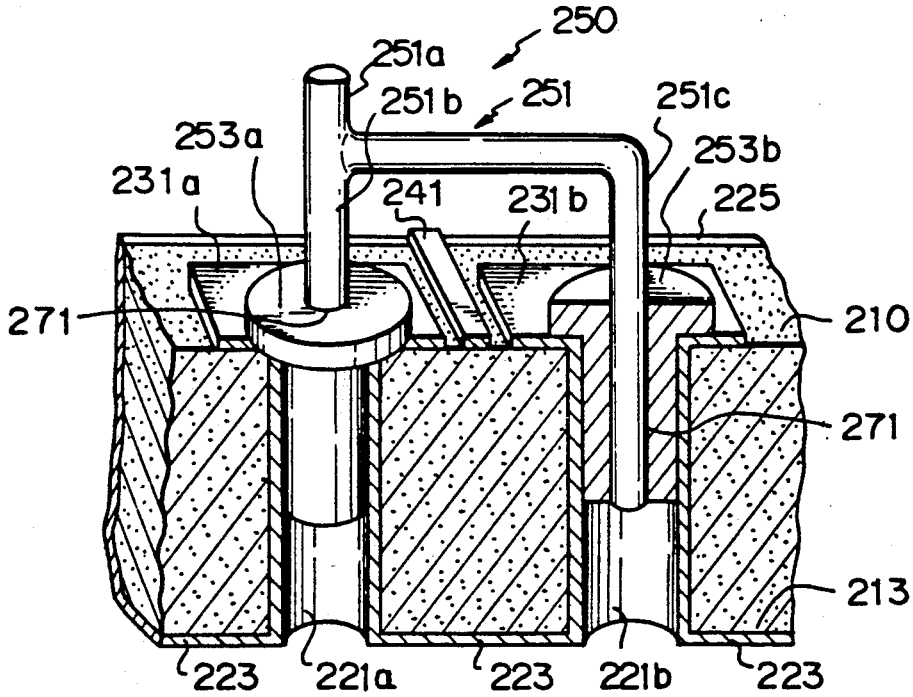
FIG. 3 is a partial cross section of the first dielectric filter 200 shown in FIG. 2, taken along lines A-A'.

Referring to FIG. 3, there is illustrated a partial cross section of the first dielectric filter 200 shown in FIG. 2, substantially taken along lines A-A'.

The inner conductive layers 221*a*–221*d* are electrically connected with one another by means of a bottom conductive layer 223 which may also be formed of silver or copper on the bottom surface 213 of the block 210. The bottom conductive layer 223 is electrically connected with similarly formed side conductive layers 225 provided on the side surfaces 215*a*, 215*b*, 217*a* and 217*b*.

The four inner conductive layers 221*a*–221*d*, surrounded by the dielectric material enclosed in the side and bottom conductive layer, act as first, second, third and fourth dielectric resonator 235*a*, 235*b*, 235*c* and 235*d* which are respectively resonant with predetermined frequency signals in the predetermined range.

The first, second, third and fourth resonators 235*a*, 235*b*, 235*c* and 235*d* have top conductive layers 231*a*, 231*b*, 231*c* and 231*d*, shown in FIGS. 2 and 3. The top conductive layers 231*a*–231*d* form collars covering the portions of the top surface 211 surrounding the four holes 219a–219d and are connected to the corresponding inner conductive layers 221a–221d.

The block 210 further has first, second and third coupling conductive layers 241, 243 and 245 provided on the top surface 211 thereof. The first coupling conductive layer 241, connected to the side conductive layer 225 covering the first side surfaces 215a and 215b, is spaced from and provided between the top conductive layers 231a and 231b of the first and second resonator 235a and 235b in order to adjust the coupling frequencies between the first and second resonators 235a and 235b, while the second coupling conductive layer 243, connected to the side conductive layer 225 covering the first side surface 215a and 215b, is spaced from and provided between the top conductive layers 231c and 231d of the third an fourth resonators 235c and 235d in order to adjust the coupling frequencies between the third and fourth resonators 235c and 235d. The third conductive layer 245, which is extends from the first side surface 215a to the middle portion of the top surface and is connected to the side conductive layer 225 covering the first side surface 215a, is spaced from and provided between the top conductive layers 231b and 231c of the second and third resonators 235d and 235c in order to adjust the coupling frequencies between the second and third resonators.

The thickness of each of the conductive layers 221, 223, 225, 231, 241, 243 and 245 is about 2 microns.

The above mentioned structure of the dielectric filter 200 is disclosed in more detail in co-owned U.S. application of Ser. No. 7/227,874, filed on Aug. 3, 1988 now U.S. Pat. No. 4,855,673 which is incorporated herein by reference.

The first dielectric filter 200 in FIG. 2 further employs first and second coupling terminals 250 and 260. The first and second coupling terminals 250 and 260 have first and second "h"-shaped conductive parts 251 and 261 whose arms 251a and 261a respectively form the input and output terminals of either the transmitter filter 101 in FIG. 1A or the first receiver filter 151 in FIG. 1B. The first and second coupling terminals 250 and 260 each further includes two bushings 253a, 253b, 263a and 263b, made of dielectric materials such as polypropylene, polycarbonate, epoxy resin or ABC resin, and each having a thin round recess 271 therein. The legs 251b, 251c, 261b and 261c of the first and second conductive parts 251 and 261 are fitted into the recesses 271 of bushings 253a, 253b, 263a and 263b. As is indicated in FIG. 3, the bushings 253a, 253b, 263a and 263b are fitted into the corresponding holes 219a, 219b, 219c and 219d so that the legs 251b, 251c, 261b and 261c of the first and second conductive parts 251 and 261 are coupled with the corresponding inner conductive layers 221a, 221b, 221c and 221d.

Figure 4:
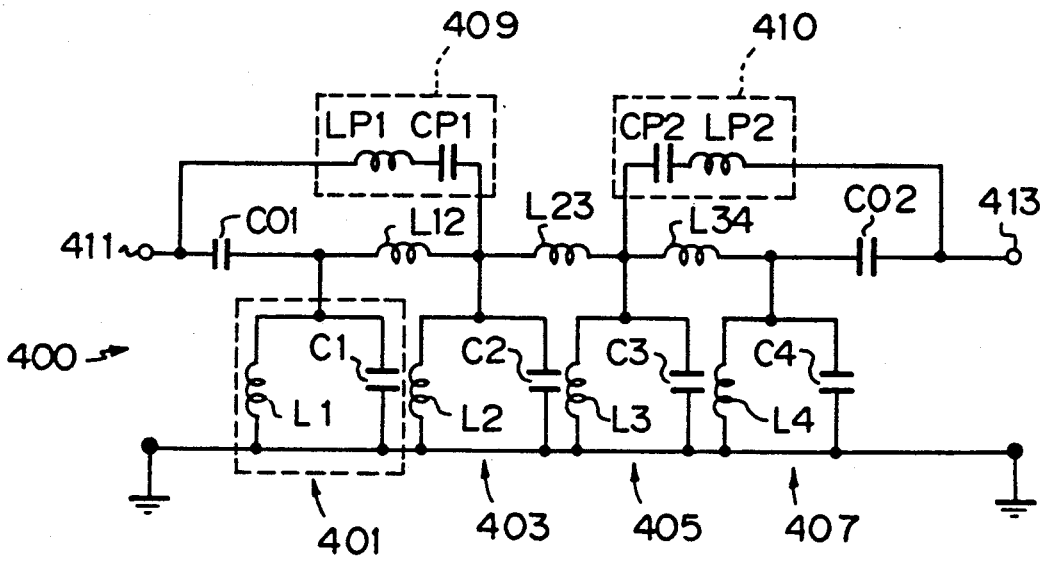
FIG. 4 is a schematic equivalent circuit of the first dielectric filter 200.

Referring to FIG. 4, there is illustrated an equivalent circuit 400 of the dielectric filter 200 shown in FIG. 2.

The equivalent circuit 400 has input and output terminals 411 and 413 formed by the respective arms 251a and 261a of the conductive parts 251 and 261 in FIG. 2, and first second, third and fourth resonator circuits 401, 403, 405 and 407 corresponding to the first, second, third and forth resonators 235a, 235b, 235c and 235d. Each resonator circuits 401, 403, 405 and 407, formed by respective capacitances C1, C2, C3 and C4 and inductances L1, L2, L3 and L4, is coupled to adjacent resonators by means of inductances L12, L23, L34 set up by the first, second and third coupling conductive layers 241, 243 and 245. The input terminal 411 is coupled to the first resonator circuit 401 through a capacitance C01 set up between the leg 251b of the first conductive part 251 and the inner conductor 221a through the bushing 253a, and further is coupled to the second resonator circuit 403 through a inductor Lp1, set up by the first conductive part 251, and a composite capacitance Cp1 which is composed of the capacitance C01 and a capacitance set up between the leg 251c of the first conductive part 251 and the inner conductor 221b through the bushing 253b. The output terminal 413 is coupled to the fourth resonator circuit 407 through a capacitance C02 set up between the leg 261b of the second conductive part 261 and the inner conductor 221d through the bushing 263a, and further is coupled to the third resonator circuit 405 through a inductor Lp2, set up by the second conductive part 261, and a composite capacitance Cp2 which is composed of the capacitance C02 and a capacitance set up between the leg 261c of the second conductive part 261 and the inner conductor 221c through the bushing 263b. First and second coupling terminal circuits 409 and 410, composed of Cp1, Lp1, Cp2 and Lp2, are set up by the respective first and second coupling terminals 250 and 260.

The above mentioned circuit 400 has first and second maximum values of the attenuation, at first and second maximum attenuated frequencies $f_{\infty 1}$ and $f_{\infty 2}$ lying the outside the first frequency range. That is, they lie outside the pass band of the circuit 400, and are determined in part by means of the respective inductances $L_p1$ and $L_p2$ and composite capacitances $C_p1$ and $C_p2$, respectively set up by the first and second coupling terminal circuits 409 and 410 in FIG. 4. The first maximum value of the attenuation against the first maximum attenuated frequency $f_1$ set up by the first coupling terminal circuit 409 can be calculated in the following manner: The matrix F composed of the first resonator 401 and the first coupling terminal circuit 409 is expressed by the following matrix (1):

$$F = \frac{1}{K1}\begin{vmatrix} A & B \\ C & D \end{vmatrix}, \tag{1}$$

Wherein $$A = B2 + \frac{1}{S*C_p1}\left(1 + \frac{C1}{C01} + \frac{1}{S^2*L1*C01}\right),$$

$$B = \frac{[L1 + L12 + S^2 * L1 * L12 * (C01 + C1)]}{S^2 * L1 * C01 + C_p1},$$

$$C = \frac{C1}{C01} + \frac{L12}{L1} + \frac{C1}{C_p1} + \frac{1}{S2*L1} * \left(\frac{1}{C01} + \frac{1}{C_p1}\right) + S^2 * L12 * C1,$$

$$D = B_2 + \frac{1}{S*C_p1} * \left(1 + \frac{L12}{L1} + S^2 * L12 * C1\right),$$

$$B2 = \frac{[L1 + L12 + S^2 * L1 * L12 * (C01 + C1)]}{S * L12 * C01},$$

$$K1 = \frac{1}{S*C_p1} + B_2,$$

$s=j\omega\pi_x$ (j is an imaginary unit, $\omega x=2\ f_x$, $f_x$ is a frequency), and herein the value of $L_1$ of the first coupling terminal circuit 409 is ignored since generally $|Lp^1| << |1/\omega C_p 1|$, that is, the impedance of the capacitance $C_p 1$ is significantly larger than that of the inductance $Lp_1$.

Since the frequency $f_x$ of the above matrix (1) is the first maximum attenuated frequency $f_1$ at the time of $K1=0$, according to the matrix (1) the first maximum attenuated frequency $f_1$ ($=\omega_1/2$) can be expressed by the following equation (2):

$$f_{001} = \sqrt{\frac{L1 * C01 + L1 * C_p1 + L12 * C_p1}{L1 * L12 * C_p1(C01 + C1)}}, \quad (2)$$

$$= \sqrt{\frac{C01 + C_p1}{L12 * C_p1(C01 + C1)} \quad \frac{1}{L1 * (C01 + C_p1)}}. \quad (3)$$

Meanwhile, the center frequency $f_{01}$ ($=\omega 01/2\ \pi$) of the first frequency range of the above mentioned circuit 400 can be expressed by the following equation (4):

$$f_{01} = \sqrt{\frac{1}{L1 * (C0 + C1)}}. \quad (4)$$

Therefore, the equations (3) and (4) show $f_1 > f_{01}$ since $\omega_1 > \omega_{01}$. Similarly the second maximum value of the attenuation against the second maximum attenuated frequency $f_2$ can be calculated and it will be found that $f_2 > f_{01}$.

As a consequence of the foregoing calculation, the first dielectric filter 200 having the equivalent circuit 400 has at least two maximum values of the attenuation above the center frequency $f_{01}$ of the first frequency range (the pass band thereof).

Figure 5:
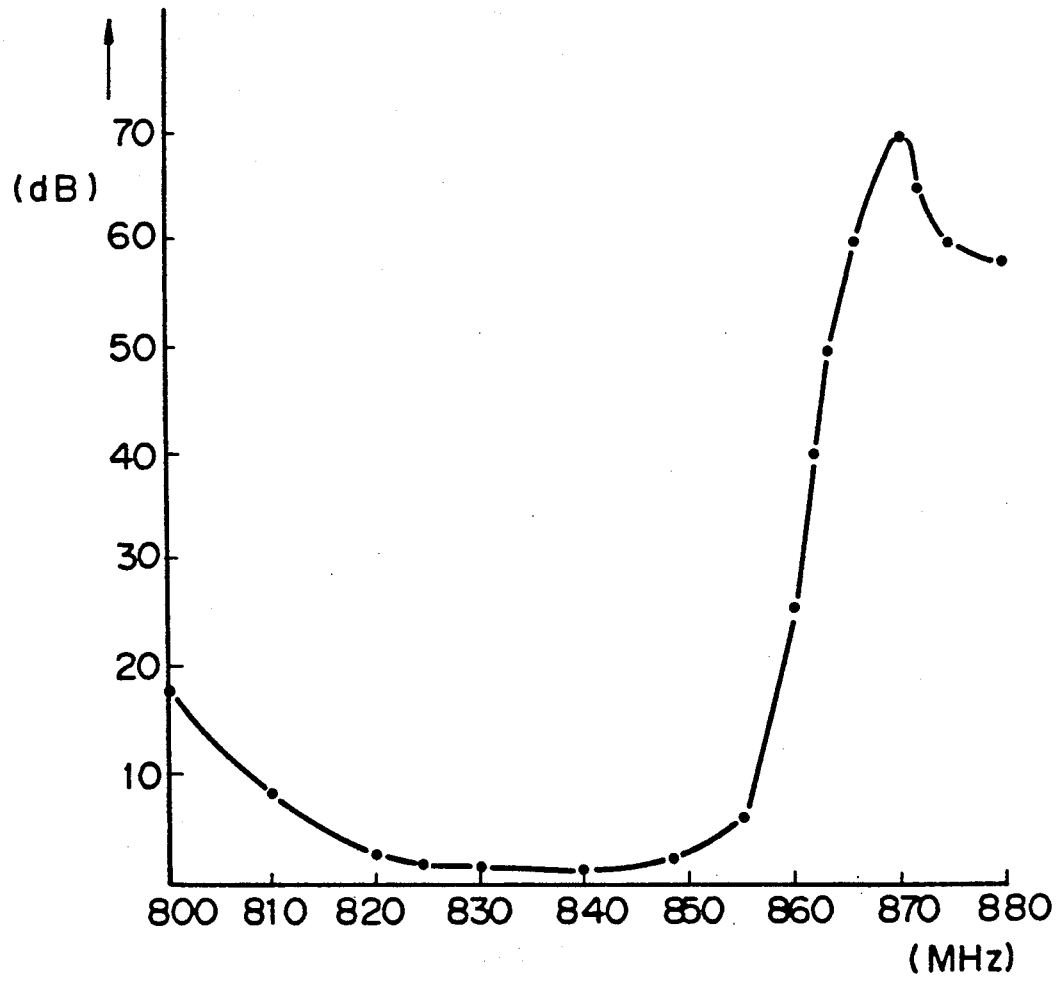
FIG. 5 is a graph illustrating the attenuation frequency characteristics of the second filter 600.

Now referring to FIG. 5, there is shown the attenuation according to the first dielectric filter 200 shown in FIG. 2 in the frequency range from 800 MHz to 800 MHz.

As shown in FIG. 5, the attenuation by the first dielectric filter 200 is low in the first frequency range from 824 MHz to 849 MHz, that is, the first dielectric filter 200 passes to the first signals in the first frequency range. In a third frequency range below the first frequency range, the attenuation is increased at a first attenuation rate, while in the fourth frequency range above the first frequency range the attenuation is suddenly increased at a second attenuation rate which is greater than the first attenuation rate by means of the first and second coupling terminals 250 and 260 so as to significantly isolate the second frequency signals, which are passed by another filter, in the second frequency range from 869 MHz to 894 MHz.

Figure 6:
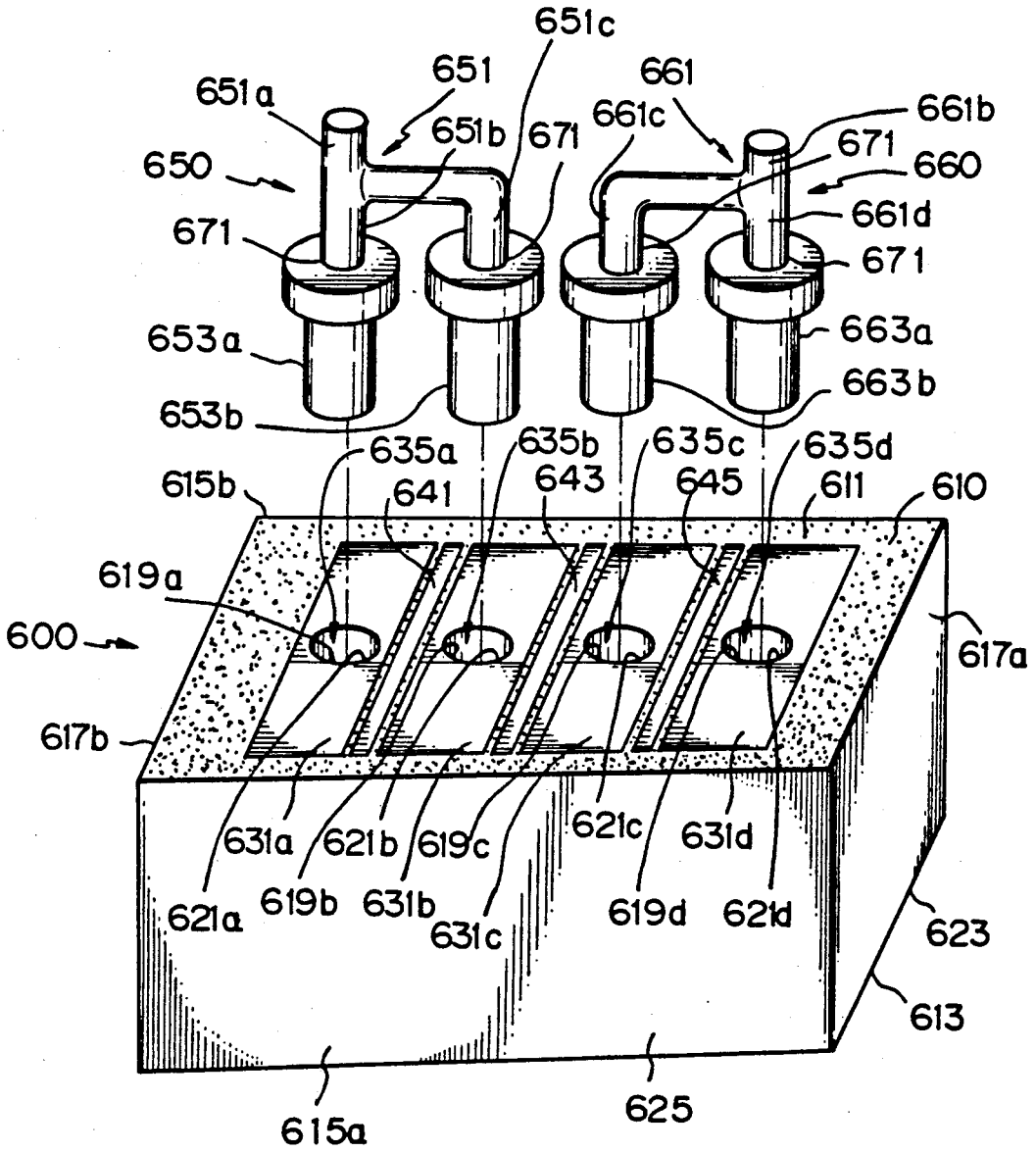
FIG. 6 is a perspective view of a second dielectric filter 600.

FIG. 6 illustrates a second dielectric filter 600 which is applicable to either the receiver filter 107 in FIG. 1A or the second receiver filter 157 in FIG. 1B.

The second dielectric filter 600, which is like the first dielectric filter 200 in FIG. 2 except for first, second and third coupling conductive layer 641, 643 and 645, includes a block 610 of ceramic materials. The block 610 has a top surface 611, a bottom surface 613, first side surfaces 615*a* and 615*b*, second side surfaces 617*a* and 617*b* and, further, four cylindrical interior surfaces therein which respectively define corresponding holes 619*a*, 619*b*, 619*c* and 619*d* each extending from the top surface 611 to the bottom surface 613. Each of the interior surfaces in the block 610 is entirely covered with a layer of a conductive material such as a silver or copper so as to form inner conductive layers 621*a*, 621*b*, 621*c* and 621*d*.

The inner conductive layers 621*a*–621*d* are also electrically connected with one another by means of a bottom conductive layer 623 on the bottom surface 613. The bottom conductive layer 623 is electrically connected with a side conductive layer 625 provided on the side surfaces 615*a*, 615*b*, 617*a* and 617*d*.

The four inner conductive layers 621*a*–621*d*, surrounded by the dielectric material enclosed by the side and bottom conductive layers 625 and 623, respectively act as first, second, third and fourth resonators 635*a*, 635*b*, 635*c* and 635*d*.

The first, second, third and fourth resonators 635*a*–635*d* have respective top conductive layers 631*a*, 631*b*, 631*c* and 631*d*, connected with the corresponding inner conductive layers 62*a*–621*d* on the top surface 611.

On its top surface 611, the block 610 further has first, second and third coupling conductive layers 641, 643 and 645 which are the provided between the side conductive layer 625 covering the first side surfaces 615*a* and 615*b*. The first coupling conductive layer 641 is spaced from and provided between the top conductive layers 631*a* and 631*b* in order to adjust the coupling frequencies between the first and second resonators 635*a* and 635*b*. The second conductive layer 643 is spaced from and provided between the top conductive layers 231*b* and 231*c* of the second and third resonators 635*b* and 635*c* in order to adjust the coupling frequencies between the second and third resonators. The third coupling conductive layer 645 is also spaced from and provided between the top conductive layers 631*c* and 631*d* of the third and fourth resonators 635*c* and 635*d* in order to adjust the coupling frequencies between the third and fourth resonators 635*c* and 635*d*.

The second dielectric filter 600 in FIG. 6 further employs first and second coupling terminals 650 and 660. The first and second coupling terminals 650 and 660 respectively have first and second "h"-shaped conductive parts 650 and 661 whose arms 651*a* and 661*a* form the input and output terminals of either the receiver filter 107 in FIG. 1A or the second receiver filter 157 in FIG. 1B, The first and second coupling terminals 650 and 660 further include two bushings 653*a*, 653*b*, 663*a* and 663*b* each having a thin round recess 671 therein. The legs 651*b*, 651*c*, 661*b* and 661*c* of the first and second conductive parts 651 and 661 are fitted into the respective recesses 671 of bushings 653*a*, 653*b*, 663*a* and 663*b*. The bushings 653*a*, 653*b*, 663*a* and 663*b*, are fitted into the corresponding holes 619*a*, 619*b*, 619*c* and 619*d* so that the legs 651*b*, 651*c*, 661*b* and 661*c* of the first and second conductive parts 651 and 661 are coupled with the corresponding inner conductive layers 621a–621*d*.

Figure 7:
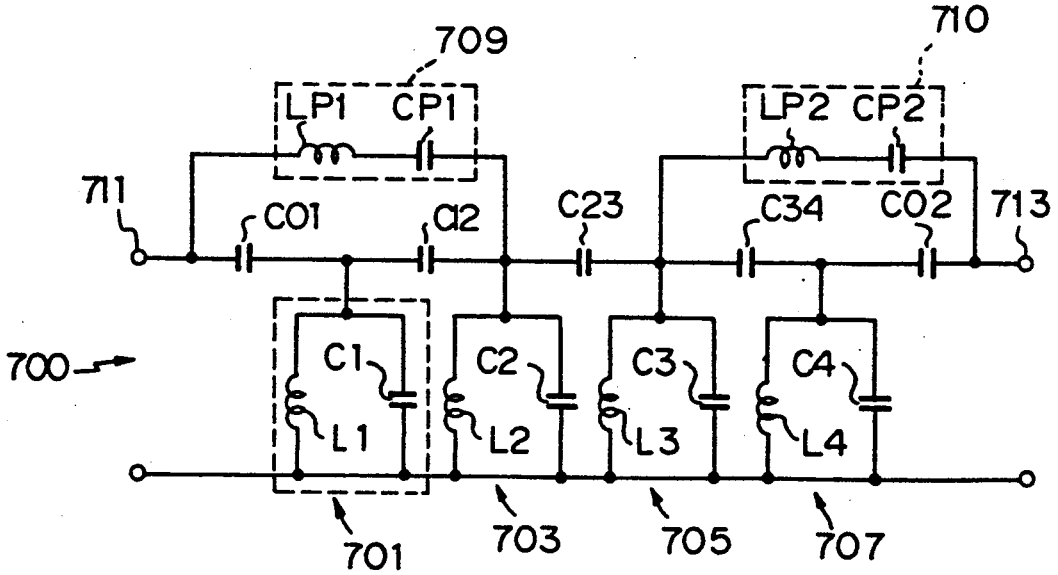
FIG. 7 is a schematic equivalent circuit of the second dielectric filter 600.

FIG. 7 illustrates an equivalent circuit 700 for the second dielectric filter 600 shown in FIG. 6.

The equivalent circuit 700 has input and output terminals 711 and 713 formed by the respective arms 651*a* and 661*a* of the conductive parts 651 and 661 in FIG. 6, and first, second, third and fourth resonator circuits 701, 703, 705 and 707 corresponding to the first, second, third and fourth resonators 635*a*, 635*b*, 635*c* and 635*d*. Each resonator circuits 701, 703, 705 and 707, which are formed by capacitances C1, C2, C3 and C4 and inductances L1, L2, L3 and L4, is coupled to adjacent resonators by means of capacitance C12, C23, C34 set up by the first, second and third coupling conductive layers 241, 243 and 245. The input terminal 711 is coupled to the first resonator circuit 701 through a capacitance C01 set up between the leg 651*b* of the first conductive part 651 and the inner conductor 621*a* through the bushing 653*a*, and is further coupled to the second resonator circuit 403 through a inductor $L_p1$, set up by the first conductive part 651, and a composite capacitance $C_p1$ which is composed of the capacitance C01 and a capacitance set up between the leg 651*c* of the first conductive part 651 and the inner conductor 621*b* through the bushing 653*b*. The output terminal 713 is coupled to the fourth resonator circuit 707 through a capacitance C02 set up between the leg 661*b* of the second conductive part 661 and the inner conductor 621*d* through the bushing 663*a*, and is further coupled to the third resonator circuit 705 through a inductor $L_p2$, set up by the second conductive part 661, and a composite capacitance $C_p2$ which is composed of the capacitance C02 and a capacitance set up between the leg 661*c* of the second conductive part 661 and the inner conductor 621*c* through the bushing 663*b*. First and second coupling terminal circuits 709 and 710, composed of $L_p1$, $C_p1$, $L_p2$ and $C_p2$, are set up by the first and second coupling terminals 650 and 660.

The above mentioned circuit 700 has first and second maximum values of the attenuation near the second frequency rage, that is, the pass band of the circuit 700, by means of the respective inductances $L_p1$ and $L_p2$ and composite capacitances $C_p1$ and $C_p2$, respectively set up by the first and second coupling terminal circuits 709 and 710 in FIG. 7.

The first maximum value of the attenuation set up by the first coupling terminal circuit 709 can be calculated in the following manner:

The matrix F composed of the first resonator 701 and the first coupling terminal circuit 709 is expressed by the following matrix (5):

$$F = \frac{1}{K2}\begin{vmatrix} A & B \\ C & D \end{vmatrix}, \tag{5}$$

wherein $$A = B3 + \frac{1}{S*C_p1}\left(1 + \frac{C1}{C12} + \frac{1}{S^2*L1*C12}\right),$$

$$B = \frac{1}{S^2*C01*C12*C_p1}\left(C01 + C1*C12 + \frac{1}{S^2*L1}\right),$$

$$C = \frac{C1}{C01} + \frac{C1}{C12} + \frac{C1}{C_p1} + \frac{1}{S^2*L1}\left(\frac{1}{C01} + \frac{1}{C12} + \frac{1}{C_p1}\right),$$

$$D = B_3 + \frac{1}{SC_p1}*\left(1 + \frac{C1}{C12} + \frac{1}{S^2*L12*C1}\right),$$

$$E = \frac{1}{S*C01*C12}*\left(C01 + C1 + C12 + \frac{1}{S^2*L1}\right),$$

-continued $$K = \frac{1}{S*C_p1} + B_3,$$

$s = j\omega x$ (j is an imaginary unit, $\omega_x = 2f_x$, $f_x$ is a frequency), and herein the value of $L_p1$ of the first coupling terminal circuit 709 is ignored since generally $|L_p1| << |1/\omega C_p1|$, that is, the impedance of the capacitance $C_p1$ is significantly larger than that of the inductance $L_p1$.

Since the frequency $f_x$ of the above matrix (5) is the first maximum attenuated frequency $f_1$ at the time of K2=0, according to the matrix (5) the first maximum attenuated frequency $f_1$ ($=\omega_1/2\pi$) can be expressed by the following equation (6):

$$\frac{1}{\omega_{001}} = \sqrt{L1\frac{C01*C12}{C_p1} + L1(C01 + C1 + C12)}\ . \tag{6}$$

Meanwhile, the center frequency $f_{02}$ ($=\omega_{02}/2\pi$) of the second frequency range of the above mentioned circuit 700 can be expressed by the following equation (7):

$$\frac{1}{\omega_{01}} = \sqrt{L1(C0 + C1 + C12)}\ . \tag{7}$$

Therefore, the equations (6) and (7) show that $f_1 < f_{01}$ since $1/\omega_1 < 1/\omega_{01}$. Similarly the second maximum value of the attenuation against the second maximum attenuated frequency $f_2$ can be calculated and it will be found that $f_2 < f_{02}$.

As a consequence of the foregoing calculation, the second dielectric filter 600 having the equivalent circuit 700 has at least two maximum values of the attenuation below the center frequency $f_{02}$ of the second frequency range (the pass band thereof).

Figure 8:
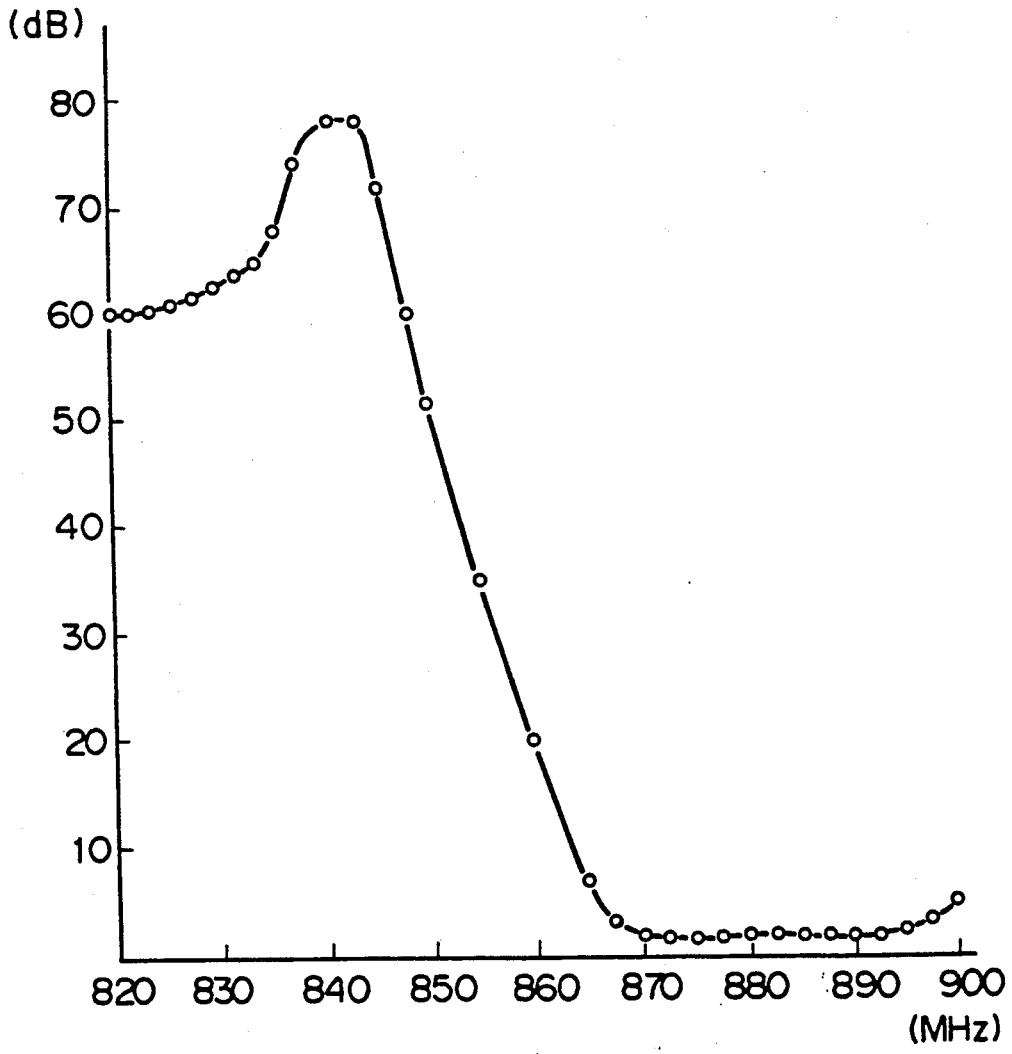
FIG. 8 is a graph illustrating the attenuation frequency characteristics of the second dielectric filter 600.

FIG. 8 shows the attenuation characteristics for the second dielectric filter 600 shown in FIG. 6 in the frequency range from 820 HMz to 900 HMz.

As shown in FIG. 8, the attenuation by the second dielectric filter 600 is low in the second frequency range from 869 HMz to 894 HMz, that is, the second dielectric filter 600 passes the second signals in the second frequency range. In a fifth frequency range below the second frequency range, the attenuation is suddenly increased at a third attenuation rate, while in the sixth frequency range above the second frequency range the attenuation is increased at a fourth attenuation rate. The third attenuation rate is greater than the fourth attenuation rate by means of the first and second coupling terminals 650 and 660 so as to significantly isolate the first frequency signals, which are passed by the first dielectric filter, in the first frequency range from 824 MHz to 849 HMz.

It will be understood that the above description of the present invention is susceptible to various modifications, changes, and adaptations, and the same are intended to be comprehended within the meaning and range of equivalents of the appended claims.

For example, both of the first and second dielectric filters 200 and 600 can have at least one maximum value of attenuation in the range above the first frequency range and below the second frequency range if each of the first and second dielectric filters 200 and 600 has at least one coupling terminal which couples either the first resonator to the second (adjacent) resonator or the fourth (final) resonator to the third (adjacent) resonator. As a consequence, the isolating circuit, composed of such first and second dielectric filters, should sufficiently isolate the first and second frequency signals.

What is claimed is:

1. An isolating circuit for isolating a first frequency signal in a first frequency range and a second frequency signal in a second frequency range, the isolating circuit comprising:

an antenna terminal;

a first filter for isolating said first frequency signal, said first filter having a first input terminal, a first output terminal, a first conductive part with first and second portions, and means for forming first, second, and third resonators, wherein said first resonator is coupled to said first input terminal, wherein said third resonator is coupled to said first output terminal, and wherein said first portion of said first conductive part is coupled to said second resonator through a capacitance and said second portion of said first conductive part is coupled to one of said first and third resonators through a capacitance; and a second filter for isolating said second frequency signal, said second filter having a second input terminal, a second output terminal, second conductive part with third and further portions, and means for forming fourth, fifth, and sixth resonators, wherein said fourth resonator is coupled to said second input terminal, wherein said sixth resonator is coupled to said second output terminal, and wherein said third portion is coupled to said fifth resonator through a capacitance and said fourth portion is coupled to one of said fourth and sixth resonators through a capacitance.

2. A circuit according to claim 1, wherein said first filter further comprises first and second insulating bushings having respective recesses;

wherein said means for forming said first, second, and third resonators of said first filter includes a first dielectric block having a top surface, a bottom surface, and side surfaces, said first dielectric block further having interior surfaces defining respective holes extending from the top surface to the bottom surface;

a side conductive layer covering said side surfaces, a bottom conductive layer covering said bottom surface and electrically connected to said side conductive layer, and inner conductive layers covering said interior surfaces, said inner conductive layers being electrically connected to said bottom conductive layer and being spaced from said side layer at said top surface; and wherein said first and second portions of said first conductive part are inserted respectively into said recesses of said first and second insulating bushings, said first insulating bushing being disposed in said first dielectric block so as to be surrounded by said inner conductive layer of said second resonator and said second insulating bushing being disposed in said first dielectric block so as to be surrounded by said inner conductive layer of the one of said first and third resonators.

3. A circuit according to claim 2, wherein said second filter further comprises third and fourth insulating bushings having respective recesses:

wherein said means for forming said fourth, fifth and sixth resonators of said second filter includes a second dielectric block having a top surface, a bottom surface, and side surfaces, said second dielectric block further having interior surfaces defining respective holes extending from the top surface to the bottom surface of said second dielectric block, a side conductive layer covering said side surfaces of said second dielectric block, a bottom conductive layer covering the bottom surface of said second dielectric block and electrically connected to said side conductive layer on said second dielectric block, and inner conductive layers covering said interior surfaces of said second dielectric block, said inner conductive layers being electrically connected to said bottom conductive layer on said second dielectric block and being spaced from said side layer on said second dielectric block at said top surface of said second conductive block; and wherein said third and fourth portions are inserted respectively into said recesses of said third and fourth insulating bushings, said third insulating bushing being disposed in said second dielectric block so as to be surrounded by said inner conductive layer of said fifth resonator, and said fourth insulating bushing being disposed in said second dielectric block so as to be surrounded by said inner conductive layer of the one of said fourth and sixth resonators.

4. A circuit according to claim 3, wherein said first filter further has a first coupling layer on said top surface of said first dielectric block and electrically connected to said side conductive layer on said first dielectric block, said first coupling layer being spaced from and provided between two resonators coupled by said first conductive part, and wherein second filter further has a second coupling layer on said top surface of said second dielectric block, said second coupling layer being spaced from and provided between two resonators coupled by said second conductive part.

5. An isolating circuit for isolating a first frequency signal in a first frequency range and a second frequency signal in a second frequency range, said isolating circuit comprising:

an antenna terminal;

a first filter for isolating said first frequency signal, said first filter having a first input terminal, a first output terminal, at least one first conductive part, and means for forming a plurality of first resonators, wherein one of said first resonators is coupled to said first input terminal, wherein another of said first resonators is coupled to said first output terminal, and wherein each said at least one first conductive part includes a respective first portion and a respective second portion which are coupled to first resonators through respective capacitances; and a second filter for isolating said second frequency signal, said second filter having a second input terminal, a second output terminal, at least one second conductive part, and means for forming a plurality of second resonators, wherein one of said second resonators is coupled to said second input terminal, wherein another of said first resonators is coupled to said second output terminal, and wherein each said at least one second conductive part includes a respective third portion and a respective fourth portion which are coupled to second resonators through respective capacitances.

6. A circuit according to claim 5, wherein said first filter further comprises at least one first insulating bushing having a recess and at least one second insulating bushing having a recess;

wherein said means for forming a plurality of first resonators includes a first dielectric block having a top surface, a bottom surface, and side surfaces, said first dielectric block further having interior surfaces defining holes extending from the top surface to the bottom surface, a side conductive layer covering said side surfaces, a bottom conductive layer covering the bottom surface and electrically connected to said side conductive layer, and inner conductive layers covering said interior surfaces, said inner conductive layers being electrically connected to said bottom conductive layer and spaced from said side layer at said top surface; and wherein said first and second portions of each said at least one first conductive part are inserted into recess of respective first and second insulating bushings which are disposed in respective first resonators of said first filter.

7. A circuit according to claim 6, wherein said second filter further comprises at least one third insulating bushing having a recess and at least one fourth insulating bushing having a recess;

wherein said means for forming a plurality of second resonator includes a second dielectric block having a top surface, a bottom surface, and side surfaces, said second dielectric block further having interior surfaces defining holes extending from the top surface to the bottom surface of said second dielectric block, a side conductive layer covering said side surfaces of said second dielectric block a bottom conductive layer covering the bottom surface of said second dielectric block and electrically connected to said side conductive layer on said second dielectric block, and inner conductive layers covering said interior surfaces of said second dielectric block, said inner conductive layers being electrically connected to said bottom conductive layer on said second dielectric block and spaced from said side layer on said second dielectric block at said top surface of said second dielectric block; and wherein said third and fourth portions of each said at least one second conductive part are inserted into recess of respective third and fourth insulating bushings which are disposed in respective second resonators of said second filter.

8. A circuit according to claim 7, wherein said first filter further has at least one first coupling layer on said top surface of said first dielectric block and electrically connected to said side conductive layer on said first dielectric block, said at least one first coupling layer being spaced from and provided between each two first resonators coupled by said at least one first conductive part, and wherein said second filter further has at least one second coupling layer on said top surface of said second dielectric block, said at least one second coupling layer being spaced from and provided between each two second resonators coupled by said at least one second conductive part.

9. A dielectric filter comprising:

a dielectric block having a top surface, a bottom surface, and side surfaces, said dielectric block further having four interior surfaces defining respective holes extending from the top surface to the bottom surface;

a side conductive layer covering said side surfaces;

a bottom conductive layer covering said bottom surface and electrically connected to said side conductive layer;

four inner conductive layers covering said interior surfaces, said inner conductive layers being electrically connected to said bottom conductive layer and spaced from said side layer at said top surface;

input means for introducing a signal which is to be filtered into said dielectric filter, said input means including a conductive part having first and second portions, said first portion of said conductive part being capacitively coupled to one of said inner conductive layers and said second portion of said conductive part being capacitively coupled to an adjacent inner conductive layer;

output means for extracting the filtered signal from said dielectric filter, said output means including another conductive part with first and second portions, said first portion of said another conductive part being capacitively coupled to a further one of said inner conductive layers and said second portion of said another conductive part being capacitively coupled to an inner conductive layer which is adjacent said further one of said inner conductive layers; and coupling layers on said top surface of said dielectric block, each coupling layer being spaced and provided between two holes.

10. A dielectric filter according to claim 9, wherein said input means further includes a first insulating bushing having a recess and a second insulating bushing having a recess, and wherein said first and second portions of said conductive part of said input means are inserted into said recess of said first and second insulating bushings, which are disposed in respective holes.

11. A dielectric filter according to claim 9, wherein said coupling layers are electrically connected to said side conductive layer.

12. A dielectric filter according to claim 9, wherein said first and second portion of said conductive part are parallel legs and wherein said first and second portions of said another conductive part are parallel legs.

13. A dielectric filter according to claim 9, wherein said holes are disposed in a row, the first portion of the conductive part being coupled to the inner conductive layer covering the interior surface of the hole at one end of the row and the first portion of the another conductive part being coupled to the inner conductive layer covering the interior surface of the hole at the other end of the row.

* * * * *